US005435580A

United States Patent [19]

Balbinot et al.

[11] Patent Number: 5,435,580

[45] Date of Patent: Jul. 25, 1995

[54] BRAKING DEVICE PARTICULARLY FOR SKATES

[75] Inventors: Renzo Balbinot, Pieve di Soligo; Alessandro Pozzobon, Paderno di Ponzano Veneto; Mario Gonella, Conegliano, all of Italy

[73] Assignee: Nordica S.p.A., Trevignano, Italy

[21] Appl. No.: 195,102

[22] Filed: Feb. 14, 1994

[30] Foreign Application Priority Data

Mar. 5, 1993 [IT] Italy ..... TV93A0020

[51] Int. Cl.[6] ..... A63C 17/14

[52] U.S. Cl. ..... 280/11.2; 280/11.22

[58] Field of Search ..... 280/11.2, 11.22, 11.23, 280/11.36

[56] References Cited

U.S. PATENT DOCUMENTS

| | | | |
|---|---|---|---|
| 920,848 | 5/1909 | Eubank, Jr. | 280/11.36 X |
| 979,169 | 12/1910 | Kennedy | 280/11.36 X |
| 1,402,010 | 1/1922 | Ormiston | 280/11.36 X |
| 2,179,592 | 11/1939 | Goettie | 280/11.2 |
| 3,767,220 | 10/1973 | Peterson | 280/11.2 X |
| 4,275,895 | 6/1981 | Edwards | 280/11.2 |
| 5,253,882 | 10/1993 | Mitchell | 280/11.2 |

FOREIGN PATENT DOCUMENTS

| | | | |
|---|---|---|---|
| 0414522 | 2/1991 | European Pat. Off. . | |
| 0567948 | 11/1993 | European Pat. Off. | 280/11.2 |
| 0568878 | 11/1993 | European Pat. Off. | 280/11.2 |
| 959743 | 4/1950 | France | 280/11.2 |

*Primary Examiner*—Eric D. Culbreth
*Assistant Examiner*—Carla Mattix
*Attorney, Agent, or Firm*—Guido Modiano; Albert Josif

[57] ABSTRACT

Braking device particularly usable for skates including a shoe composed of a quarter articulated to a shell which is in turn associated with a supporting frame for two or more wheels. A brake is associated with the quarter and selectively interacts with the ground upon a backward rotation of the quarter.

12 Claims, 3 Drawing Sheets

BRAKING DEVICE PARTICULARLY FOR SKATES

BACKGROUND OF THE INVENTION

The present invention relates to a braking device particularly usable for skates including a shoe composed of a quarter articulated to a shell which is in turn associated with a supporting frame for two or more wheels.

Currently, in conventional roller skates, whether constituted by a shoe associated with a support for two pairs of mutually parallel wheels or by a shoe associated with a supporting frame for two or more in-line wheels, there is the problem of braking said wheels to adjust the speed of the skate.

It is known to use adapted blocks or pads, usually made of rubber, which are arranged at the toe or heel region of the shoe. When the user tilts the shoe forwards or backwards, the free end of the blocks or pads interacts with the ground and braking is thus achieved.

However, the operation of conventional brakes is not satisfactory because they require the user to rotate the shoe, and thus the frame associated therewith, at the toe or heel, and this can cause loss of balance with consequent falls.

U.S. Pat. No. 1,402,010 discloses a roller skate having a strap that can be secured on the user's leg above the malleolar region, a rod being connected to the strap.

The rod surrounds the leg to the rear and is then curved so as to laterally affect the leg until it is associated at its ends, in the malleolar region, with a lever system which is articulated to a structure protruding from the wheel supporting frame.

The lever system protrudes to the rear of the frame and is connected to a plate which is shaped approximately complementarily to the curvature of part of an underlying and facing wheel.

This solution is not free from drawbacks: first of all, a relative movement between the strap and the leg is produced during sports practice, and this does not make its use comfortable due to the continuous rubbing of the strap on the leg.

Furthermore, the plate is activated every time the user bends his leg backwards beyond a given angle, with no true and easy possibilities to vary this condition.

Since the shape of the leg is different for each user for the same rod length there is a different braking action at different rotation angles.

Furthermore, the rod acts and presses in the malleolar region, and this can cause discomfort or accidental impacts. Finally, the wheel wears out considerably.

U.S. Pat. No. 4,275,895 provides a partial solution to this drawback, and illustrates a brake for skates with two pairs of mutually parallel wheels which acts at the rear wheels.

The brake is constituted by a tongue which is associated with the shoe in a rearward region. A plate is associated with the tongue in a rearward position and is pivoted at the frame that supports the shoe.

At its free end, the plate has a transverse element on which a pair of C-shaped elements is formed at the lateral ends. Following a backward rotation imparted to the tongue, the C-shaped elements interact with the rear wheels facing them, so as to interact with their rolling surface.

Even this solution, however, has drawbacks: it is in fact structurally complicated and therefore difficult to industrialize. It also entails the presence of adapted springs that allow the tongue to return to the position in which the pair of C-shaped elements does not interact with the wheels, and this further increases structural complexity.

Furthermore, the structural configuration of the brake causes the pair of C-shaped elements to interact with the wheel even upon a minimal backward rotation imparted to the flap and therefore even for involuntary movements, and this produces unwanted braking actions and thus possible loss of balance or lack of coordination.

Finally, interaction of the C-shaped element at the rolling surface of the wheels leads to rapid wheel wear and thus to non-optimum rolling which necessarily entails continuous replacement of the wheels.

U.S. Pat. No. 4,300,781 discloses a braking device for skates that comprise pairs of mutually parallel wheels.

A brake is thus comprised which is constituted by a plate that is transversely pivoted at the rear end of the frame that supports a shoe; pads are associated with the ends of said plate and face the rolling surface of the rear pair of wheels.

The brake is activated by using a cable which is suitable to rotate the plate, in contrast with a spring associated with the support for the pair of front wheels, so as to move the pads into contact with the rolling surface of the pair of rear wheels.

This cable can be activated by means of rings or handles associated with a strap which can be arranged on the user's legs by virtue of the presence of temporary connection means.

However, this solution has considerable drawbacks: first of all, the brake activation can lead to possible loss of balance, as the user does not assume, with his body, a position suitable to control the sudden speed reduction; only the hand of the skater is in fact involved in the brake activation.

Furthermore, as sports practice can occur while wearing trousers, when the rings are pulled the strap may slip along the trousers or pull them so that they slide along the leg, hindering the braking action.

Finally, there is a loose cable which, besides being a hindrance to the skater, can accidentally catch during skating, especially since coordination of the arm-legs movement places the legs rhythmically laterally outwards.

SUMMARY OF THE INVENTION

The aim of the present invention is therefore to eliminate the drawbacks described above in conventional skates by providing a braking device for skates which is structurally very simple and easy to industrialize.

Within the scope of this aim, an important object is to provide a braking device which can be activated by the user in case of actual need and never accidentally.

Another important object is to provide a braking device that can be activated and deactivated rapidly and easily by the user.

Another important object is to provide a braking device which allows the user to preset activation of the braking action according to individual requirements.

Another important object is to provide a braking device that protects the rolling surface of the wheels from wear.

Another important object is to provide a braking device that does not hinder the user during normal sports practice.

Another object is to provide a device that associates with the preceding characteristics that of being reliable and safe in use, has low manufacturing costs and can also be applied to conventional skates.

This aim, these objects and others which will become apparent hereinafter are achieved by a braking device particularly for skates comprising a shoe composed of a quarter articulated to a shell associated with a supporting frame for a plurality of wheels, characterized in that it comprises a brake member associated with said quarter, said brake selectively interacting with the ground upon a backward rotation of said quarter.

BRIEF DESCRIPTION OF THE DRAWINGS

Further characteristics and advantages of the present invention will become apparent from the detailed description of a particular embodiment, illustrated only by way of non-limitative example in the accompanying drawings, wherein.

DESCRIPTION OF THE PREFERRED EMBODIMENTS

Figure 1:
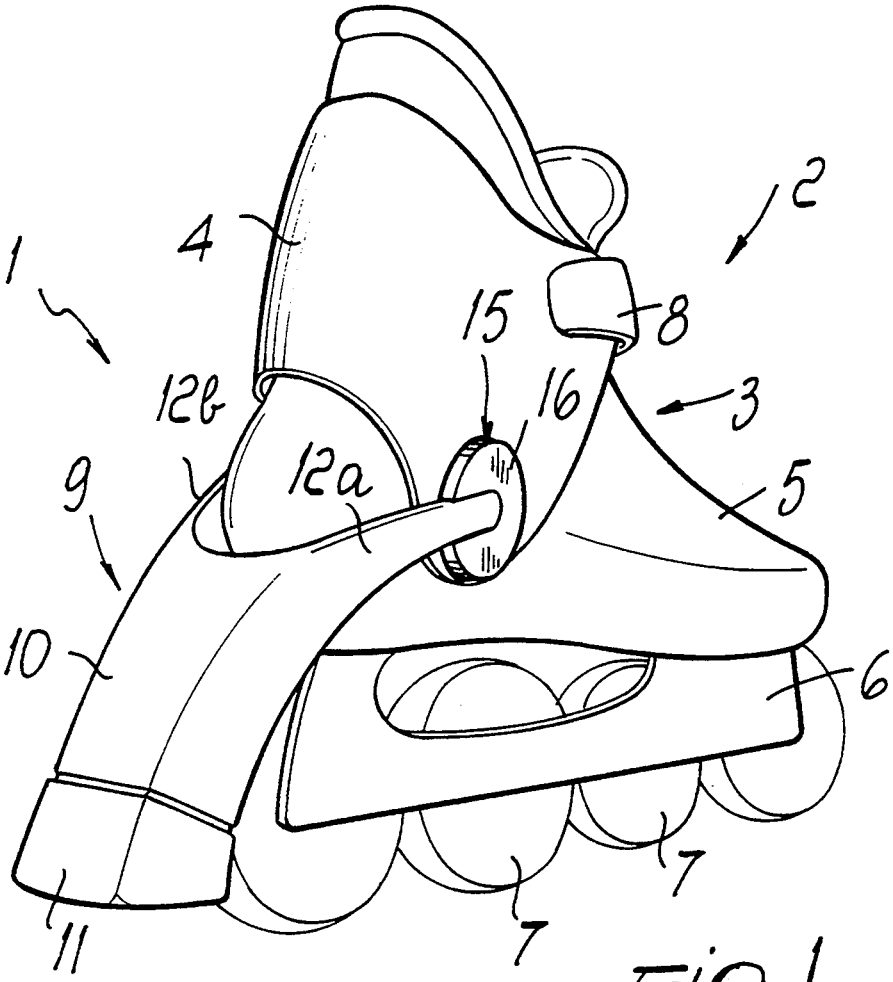
FIG. 1 is a lateral perspective view of a skate having the braking device according to the invention, in the position of normal use.
Figure 2:
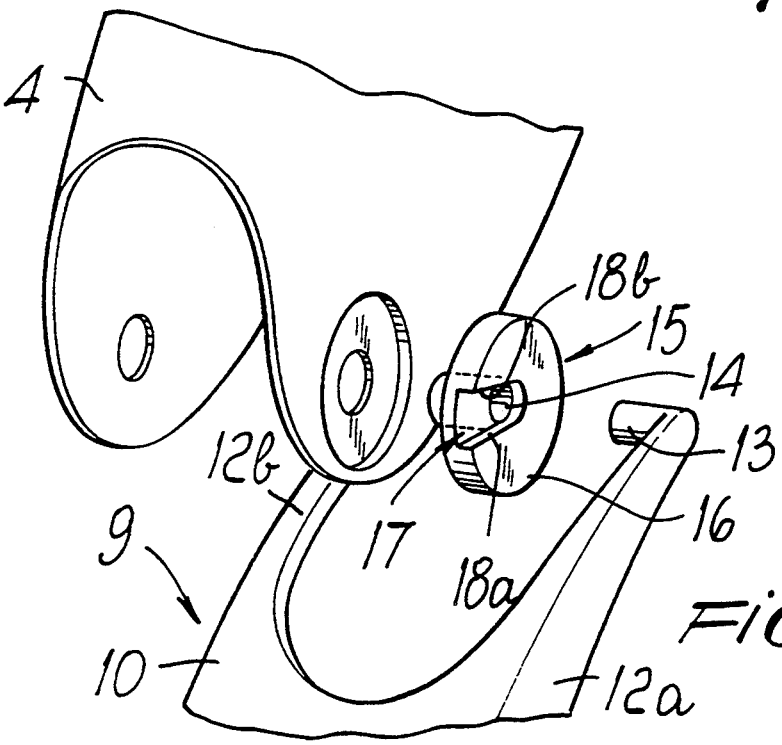
FIG. 2 is an exploded partial view of some components of the skate of FIG. 1.

With reference to the above figures, the reference numeral 1 designates the braking device, which is particularly usable for a skate designated by the reference numeral 2.

The skate comprises a shoe 3 composed of a quarter 4 that surrounds the rear and lateral region of the user's leg and is articulated to a shell 5 with which a frame 6 is associated in a downward region. The frame supports two or more possibly mutually aligned wheels, designated by the reference numeral 7.

Conventional securing levers 8 may be applied for securing the quarter 4 and the shell 5.

The braking device comprises a brake 9 that has a curved body 10 which is arranged to the rear of the shell 5 and of the frame 6. A pad 11, suitable to interact with the ground, is associated with the body 10, and a pair of lateral wings 12*a* and 12*b* protrudes from the body. The wings can be spaced mutually apart elastically and have cylindrical pins 13 at their ends.

The distance between the pair of wings is approximately equal to the width of the quarter. The wings can be arranged laterally to the quarter and to the shell and can be rotatably associated with the quarter and the shell by inserting the pins 13 within adapted first seats 14. Seats 14 are formed axially with respect to the stem of a pair of studs 15 for pivoting the shell and the quarter, which rotate rigidly with the quarter.

The assembly thus formed is then stably connected to the quarter and to the shell by riveting or by means of other conventional systems.

A second seat 17 is formed on the head 16 of each stud by removing material for part of the thickness so as to form two radial walls 18*a* and 18*b* between which the tips of the lateral wings 12*a* and 12*b* can be arranged, possibly in a snap-together manner or by abutment.

A rotation of the quarter is thus followed by an equal rotation imparted to the studs and thus to the brake.

The use of the brake according to the invention is as follows: during normal skating, the quarter 4 is free to oscillate with respect to the shell 5 together with the brake 9 without making the pad 11 of the brake interact with the ground.

The shape of the lateral wings of the brake body and of the second seats 17 formed on the heads of each stud are in fact such that the tilt imparted to the quarter while skating is such that the pad does not touch the ground.

The brake is rotated so as to make the pad 11 interact with the ground only for a given backward rotation of the quarter and thus beyond a given or presettable angle.

The angle of backward rotation of the quarter that allows the brake to interact with the ground can be set or changed by varying the shape of the lateral wings of the brake or the angle at which the second seats 17 are formed.

It has thus been observed that the invention has achieved the intended aim and objects, a braking device having been achieved that can be activated by the user at a presettable angle of backward rotation imparted to the quarter. Furthermore, this can be achieved according to the shape and dimensions of the lateral wings of the brake or to their possible curvature with respect to the body 10 and according to the angle at which the second seats 17 are formed or located.

Furthermore, both activation and deactivation of the brake are very simple, so as to achieve a braking device which is structurally simple and easy to industrialize and can also be easily applied to skates of conventional design.

The brake according to the invention is susceptible to numerous modifications and variations, all of which are within the scope of the same inventive concept.

Figure 3:
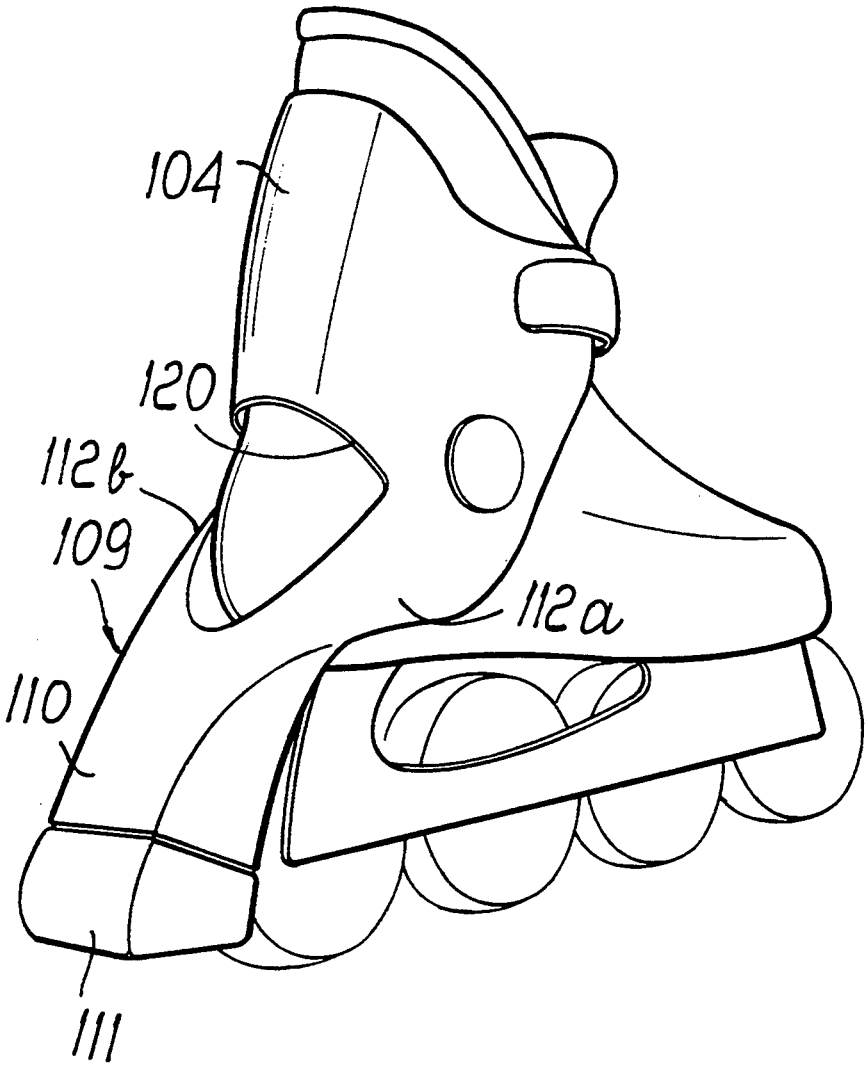
FIG. 3 is a side perspective view of a skate according to a second aspect of the invention.

For example, FIG. 3 shows a skate having a brake according to a second aspect of the invention, wherein the tips of the lateral wings 112*a* and 112*b* of the body 110 of the brake 109 can be rigidly coupled to the quarter 104, for example by forming them during the molding of the quarter, and thus protrude laterally and below it at the lower perimetric edge 120.

In this solution, it is the shape of the lateral wings or of the body 110 of the brake that determines the angle of backward rotation of the quarter beyond which the pad 111 interacts with the ground.

Figure 4:
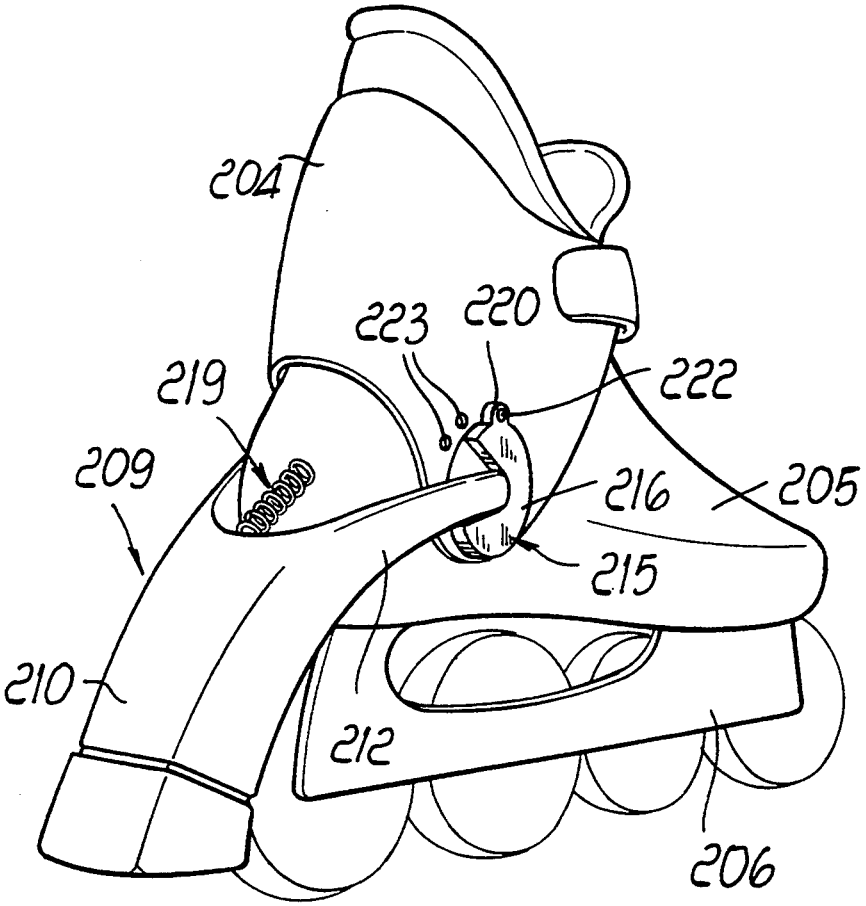
FIG. 4 is a side perspective view of a skate according to a third aspect of the invention.
Figure 5:
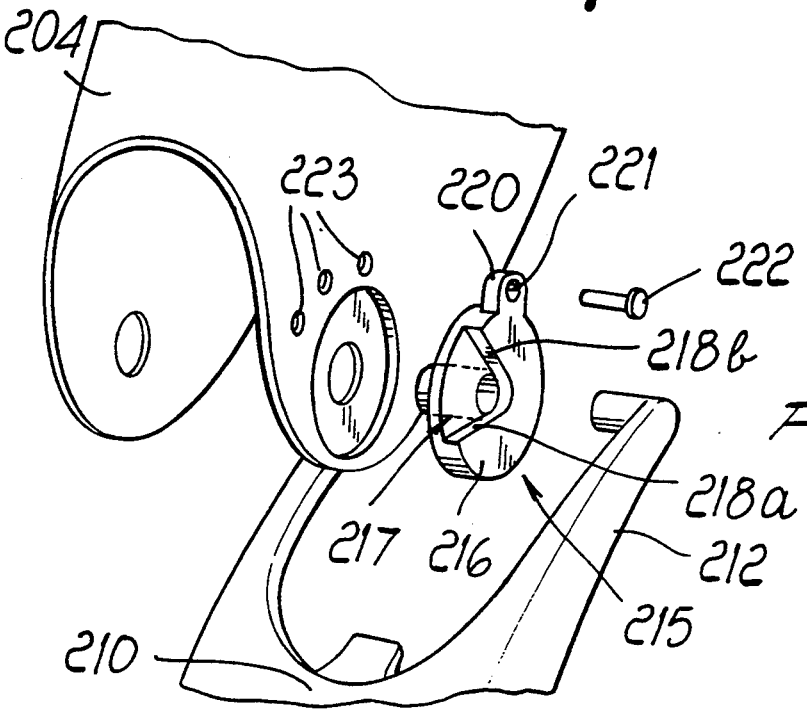
FIG. 5 is an exploded partial view of some components of the skate illustrated in FIG. 4.

As an alternative, as shown in FIGS. 4 and 5, seats 217 can be formed on the head 216 of each stud 215 by removing the material for part of its thickness so as to form two radial walls 218*a* and 218*b* between which an acute angle is formed that is larger than the thickness of the tips of the lateral wings 212 of the body 210 of the brake 209.

It is thus possible to vary the degree of backward inclination of the quarter 204 beyond which interaction with the brake 209 occurs: in fact, as shown in FIG. 4, when the quarter is upright the lateral wings 212 are made to interact by abutment with the radial walls 218*a* that are adjacent to the frame 206.

A backward rotation of the quarter is followed by a simultaneous rotation of the studs 215 but not by a rotation of the brake 209 toward the ground.

There is in fact at least one elastically deformable element, such as a spring 219, that is interposed between the body 210 and the shell 205 and supports the brake in this condition.

The brake is actuated when the radial walls 218*b* interact with the lateral wings 212: the spring 219 raises the brake again upon a forward rotation of the quarter, and the angle of backward rotation of the quarter that activates the brake can furthermore be changed by changing the position of each stud 215.

Means for temporary connection to the quarter are also associated with the studs. These means are constituted by a radial tab 220 on which a first axial hole 221 for a removable pin 222 is formed.

The stem of the pin can be arranged selectively within one of a plurality of second holes 223 formed on the quarter 204 along a circle.

The different angular arrangement of the stud allows to place the second seats 217 at a different angle with respect to the ground.

Naturally, the materials and the dimensions that constitute the individual components of the structure may be the most pertinent according to the specific requirements.

We claim:

1. Braking device for skates comprising a shoe composed of a quarter articulated to a shell associated with a supporting frame for a plurality of wheels, the braking device comprising a brake member associable with said quarter, said brake member selectively interacting with the ground upon a backward rotation of said quarter, said brake member having lateral wings, each of said lateral wings having a respective cylindrical pin, said lateral wings being rigidly associable with said quarter by means of the insertion of said cylindrical pins within adapted first seats which are formed axially with respect to a stem of a pair of studs for the pivoting of said shell and said quarter, said pair of studs being rotatable rigidly with said quarter.

2. Braking device according to claim 1, wherein a second seat is formed on the head of each one of said studs by removing material for part of the head thickness so as to form two radial walls between which the ends of said lateral wings are arranged by abutment.

3. Braking device according to claim 2, wherein said brake is kept in neutral position, and thus approximately with said pad raised from the ground, by means of an elastically deformable element.

4. Braking device according to claim 3, wherein said elastically deformable element is constituted by at least one spring which is interposed between said shell and said brake.

5. Braking device according to claim 1, wherein second seats are formed on said head of each one of said studs by removing material for part of its thickness, so as to form two radial walls between which an acute angle is formed that is larger than the thickness of said pins of said lateral wings of said body of said brake.

6. Braking device according to claim 5, wherein, when the quarter is upright, said pins of said lateral wings interact by abutment with said radial walls that are adjacent to said frame, said other radial walls interacting with said pins at a given extent of backward rotation of said quarter.

7. Braking device according to claim 6, wherein an elastically deformable element, such as a spring suitable to support said body so that it is raised from the ground when the quarter is upright, is interposed between said body of said brake member and said shell.

8. Braking device according to claim 7, wherein interaction of said brake member with the ground and forward rotation of said quarter are followed by the lifting of said brake performed by said elastically deformable element.

9. Braking device according to claim 9, wherein said angle of backward rotation of said quarter that activates said brake member can be modified by varying the mutual position of each one of said studs and said quarter.

10. Braking device according to claim 9, wherein means for temporary and selective connection to said quarter are associated with each one of said studs, said means being constituted by a tab that protrudes radially with respect to said studs and on which a first axial hole for a removable pin is formed, said stem of said pin being selectively placed within a plurality of second holes formed on said quarter.

11. Braking device in combination with a skate, the skate comprising a shoe composed of a quarter articulated to a shell associated with a supporting frame for a plurality of wheels, the braking device comprising a brake member associated with said quarter, said brake member selectively interacting with the ground upon a backward rotation of said quarter, said brake member comprising: an elongated body with a first end and a second end; a braking pad connected to said first end of said elongated body for interacting with the ground; and a pair of lateral wings extending from the elongated body of said second end thereof and being connected at opposite sides to said quarter, said lateral wings being formed monolithically with said quarter at the opposite sides thereof.

12. A braking device in combination with a skate, the skate comprising a shoe composed of a quarter having opposite sides and articulated to a shell, said shell being associated with a supporting frame for a plurality of wheels, the braking device comprising a brake member associated with said quarter, said brake member selectively interacting with the ground upon a backward rotation of said quarter, said brake member comprising: an elongated body with a first end and a second end; a braking pad connected to said first end of said elongated body for interacting with the ground; and a pair of lateral wings extending from the elongated body of said second end thereof and being connected at opposite sides to said quarter, the skate comprising stud means for articulating the opposite sides of said quarter to said shell, each of said lateral wings having a respective cylindrical pin, said stud means being provided with hole means for receiving the cylindrical pins of said lateral wings, thereby to rigidly connect said lateral wings of said brake member to the opposite sides of said quarter.

* * * * *